United States Patent [19]

Laine

[11] Patent Number: 5,046,734

[45] Date of Patent: Sep. 10, 1991

[54] TABLE HOCKEY GAME

[76] Inventor: Klas I. Laine, 21600 Parainen, Simonby, Finland

[21] Appl. No.: 277,719

[22] Filed: Nov. 30, 1988

[51] Int. Cl.[5] ..... A63F 7/06

[52] U.S. Cl. ..... 273/85 B; 273/85 F; 273/129 W

[58] Field of Search ..... 273/85 R, 85 B, 85 A, 273/85 F, 129 R, 129 W, 85 E, 129 V; 446/330, 334

[56] References Cited

U.S. PATENT DOCUMENTS

| | | | |
|---|---|---|---|
| 2,698,179 | 12/1954 | Widegren et al. | 273/85 B |
| 3,912,269 | 10/1975 | Barlow | 273/85 B |
| 4,146,224 | 3/1979 | Deutsch | 273/85 B |
| 4,304,405 | 12/1981 | Laine | 273/85 B |
| 4,311,309 | 1/1982 | Bradley et al. | 273/85 B |
| 4,474,375 | 10/1984 | Stockdale | 273/85 B |

FOREIGN PATENT DOCUMENTS

| | | | |
|---|---|---|---|
| 2037526 | of 1972 | Fed. Rep. of Germany | 273/85 F |
| 2430826 | of 1975 | Fed. Rep. of Germany | 273/85 F |
| 2445012 | of 1976 | Fed. Rep. of Germany | 273/85 B |
| 1354075 | of 1964 | France | 273/85 B |
| 38634 | 2/1936 | Netherlands | 273/85 B |
| 893003 | 4/1962 | United Kingdom | 273/85 B |

*Primary Examiner*—Edward M. Coven
*Assistant Examiner*—Sebastiano Passaniti
*Attorney, Agent, or Firm*—Nolte, Nolte and Hunter

[57] ABSTRACT

A table hockey game has a playing surface, goals, and a plurality of toy hockey players. Two of the toy hockey players on each side are movable to and from positions behind their opponent's goal. The hockey players move along guides comprising vertically spaced parallel slots. Rotational and translational motion is imparted to toy players by actuator shafts, some of which are articulated by a universal joint. The actuator shafts are located at a plurality of levels beneath the playing surface.

6 Claims, 7 Drawing Sheets

TABLE HOCKEY GAME

FIELD OF INVENTION

The present invention relates to a table hockey game.

BACKGROUND OF THE INVENTION

Various table hockey games have long been known, in which a plurality of toy hocky players are rotated and are moved across a playing surface by actuators, and are used to manipulate a puck towards a goal.

THE INVENTION

The present invention comprises an improvement on such games in which two of the toy players can be moved to and from positions behind an opponent's goal. The movement of the toy players in the present invention is unusually smooth and friction free, and the players have an unusually broad sweep of movement across the playing surface. This is achieved by a combination of three major structural improvements. The first is an improved guide means for restricting the movements of the players. These guides comprise a pair of vertically spaced parallel slots. The lower slot guides a selectively shaped shaft bearing which rotatably supports the shaft upon which the player is mounted.

The second improvement is the use of a universal joint joining two actuator shafts of each player whose slot curves 90° as it extends from a position near the center line to a position behind the goal. The universal joint allows for this sweeping and sharply angled motion of each such player without introducing significant friction which might impede either the translational or rotational motion of the player.

The third improvement comprises the placement of the various actuator shafts and associated actuator gears at a plurality of levels below the playing surface. This allows the actuator shafts to cross over each other and thus allows a more complicatedly intertwined range of motions of the players.

DETAILED DESCRIPTION OF THE DRAWINGS

Figure 1:
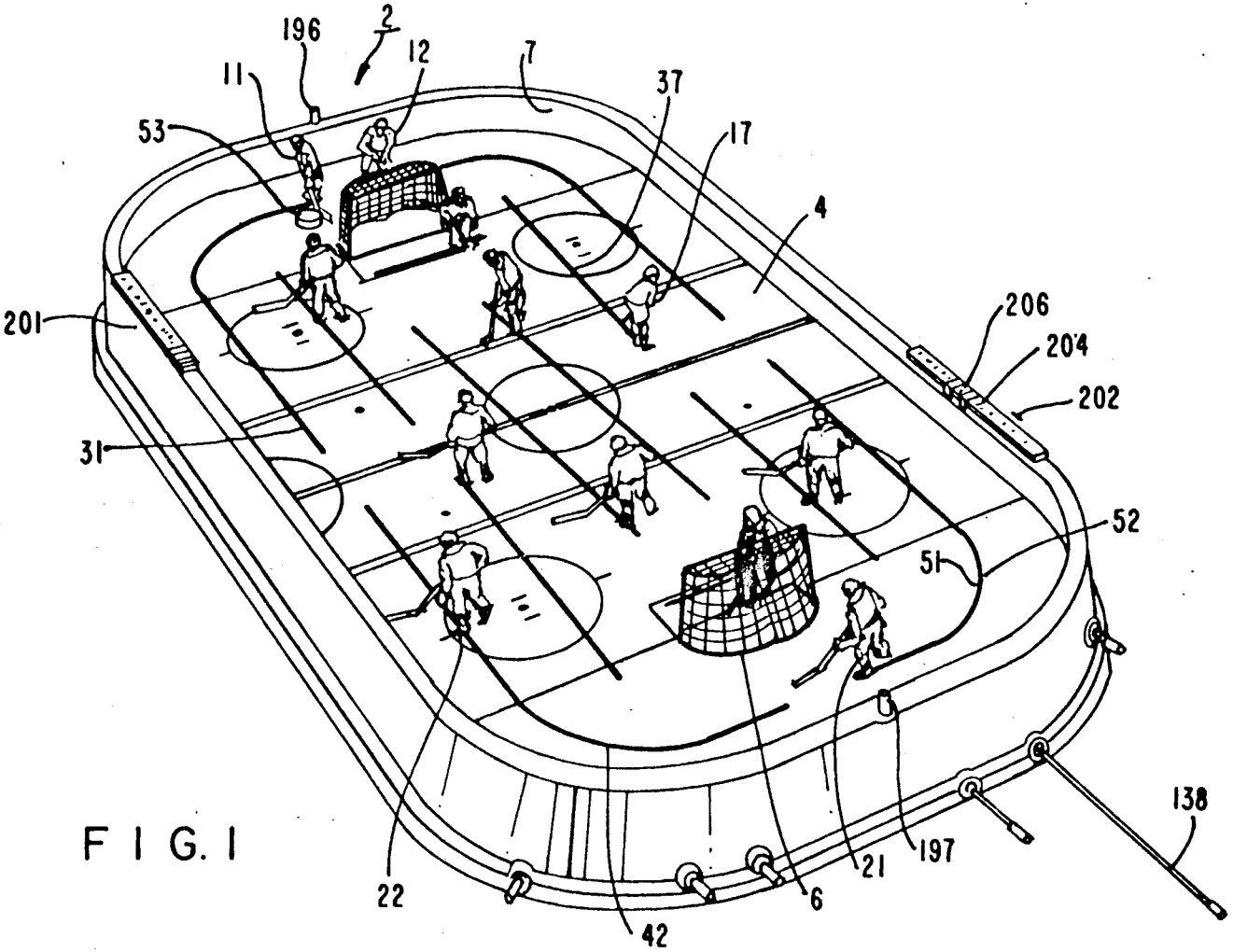
FIG. 1 is a perspective view of a gaming apparatus of the present invention.
Figure 3:
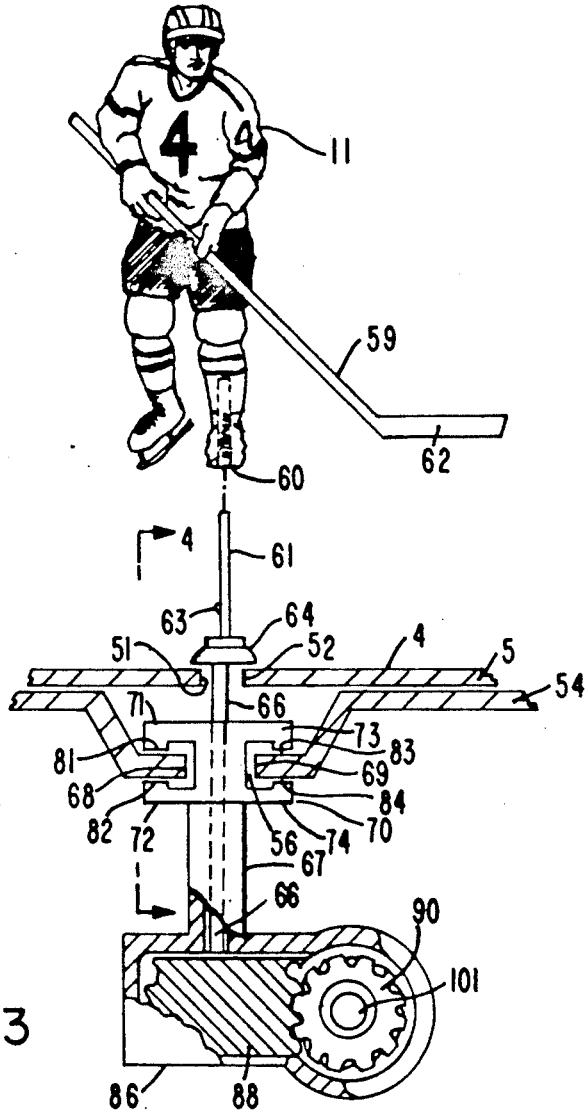
FIG. 3 is an elevation in partial cross-section identified through a plane as 3 in FIG. 4 of the playing surface showing a player and mounting, partially in section.

FIG. 1 shows the game apparatus generally designated 2. It comprises a playing surface 4 which is the upper surface of an upper sheet of plastic 5 (FIG. 3). Goals 6 (FIG. 1) are disposed near either end of the playing surface which is bounded by a curved wall 7 which completely surrounds playing surface 4 to comprise a rink. Toy hockey players 11-22 are moveably and rotatably mounted above playing surface 4. Movement of the hockey players 11-22 is allowed and restricted by guides 31-42, each of which comprises a slot along which the players may be moved.

Each slot is defined by a pair of upper edges 51-52. Also shown on playing surface 4 is puck 53 which may be of a plastic material such as vinyl, and possibly weighted within by a heavier material such as iron. The puck may or may not be magnetized. Magnetization permits the puck to be moved toward the hockey stick and increases the versatility with which the puck may be manipulated.

Figure 2:
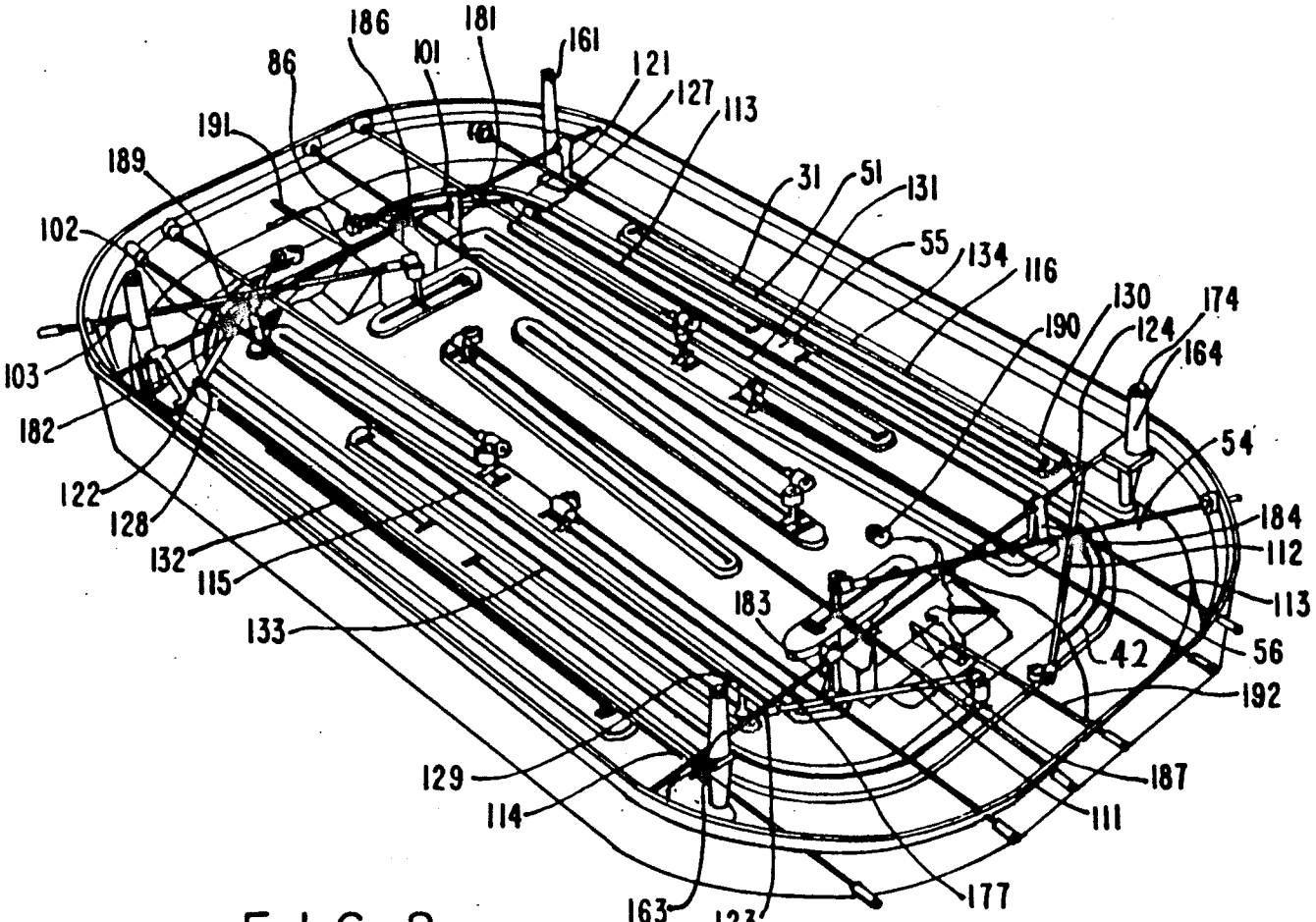
FIG. 2 is a perspective view thereof from below.

FIG. 2 shows a view of the underside of the playing apparatus. The underside comprises a second sheet, i.e. an undersheet of plastic. This undersheet 54 comprises a plurality of linear protrusions 55, each comprising a slot 56 which also comprise guides 31-42. See FIG. 6 for greater detail.

Figure 4:
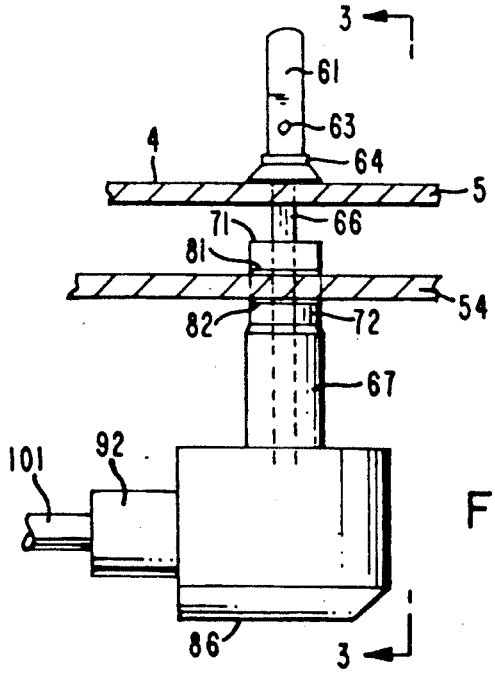
FIG. 4 is a side elevation thereof in partial section through a plane identified as 4 in FIG. 3.

The guides are shown in greater detail in section in FIGS. 3 and 4. Player 11 holds a hockey stick 59, preferably of steel or other magnetically attractable material. Player 11 comprises a hole 60 in his foot and leg, into which slideably fits player mounting post 61. To set up, the player is placed atop mounting post 61 with the hockey stick head 62 oriented away from a footstop 63. Footstop 63 limits the downward movement of player 11 and thereby places hockey stick head 62 at an appropriate height above playing surface 4. Pedestal 64 helps locate shaft 66 at the appropriate elevation. Upper edges 51, 52 of sheet 5 define the upper slot and help guide shaft 66 along the upper slot. Shaft 66 is rotatably mounted in shaft tube 67. Shaft tube 67 is flanked on either side by a second pair of edges, lower edges 68, 69 which define lower slot 56. These edges also serve to laterally steady and guide the hockey player in its movement along the slot. Two pairs 70 of arms 71-72, 73-74 protrude from opposite sides of the shaft tube. Each arm 71-74 comprises a slider 81-84. Sliders 81-82 run along the upper surface and lower surface of undersheet 54 near edge 68 and sliders 83-84 run along near edges 69. The sliders help to locate player 11 vertically and also help to maintain a vertical alignment of the player and his mounting means, which not only result in smoother play but help to reduce sliding friction. No matter what the position or attitude of the player, he does not stick.

Depending from the bottom of shaft tube 67 is worm gear housing 86. This worm gear housing contains a horizontal worm gear 88 which is coupled to shaft 66 and drives the shaft and player rotationally through an unlimited horizontal arc. Vertical worm gear 90 drives horizontal worm gear 88 and is itself coupled by shaft coupling 92 to actuator shaft 101 which is driven directly or indirectly by the hands of a person playing the game. Thus, the worm gears provide transmission means for connecting actuator shaft 101 to vertical shaft 66 and for rotating vertical shaft 66 by rotation of actuator shaft 101.

Returning to FIG. 2, each worm gear housing 86 can be seen coupled to its respective actuator shaft 101-112. Four of these actuator shafts 101-102, 111-112 terminate in universal joints 121-124 which couple them to actuator shafts 113-116. This creates an articulated actuator shaft such as 112, 124, 116 which allow the four corner players, 11, 12, 21, 22 in FIG. 1, to move behind the goals 6 in a sweeping curve which takes them out to mid-playing surface. Movement of universal joints 121-124 (FIG. 2) is restricted by joint bearings 127-130 which run in their own associated slots 131-134 in the undersheet 54.

Figure 7:
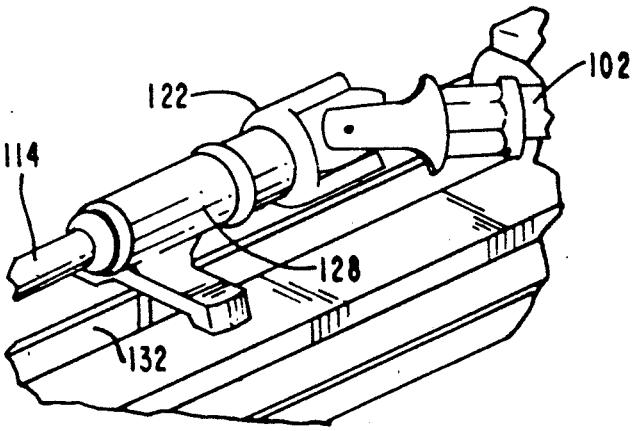
FIG. 7 is a similar view detailing a universal joint.

FIG. 7 shows universal joint 122 in greater detail, as it couples actuator shafts 102 and 114. shaft 114 is rotatably born by joint bearing 128.

Figure 8:
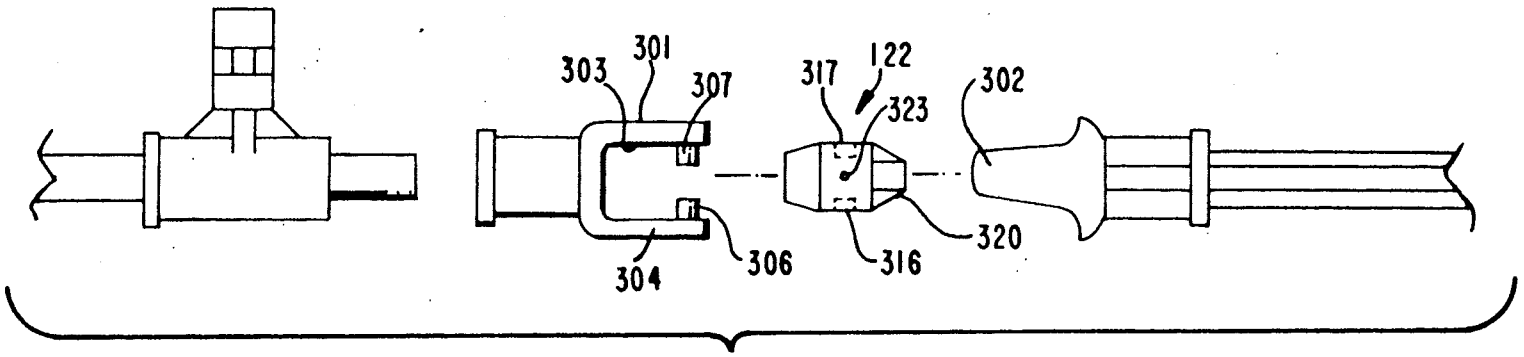
FIG. 8 is an exploded elevation of said joint.

As in FIG. 8, joint 122 comprises a pair of U-shaped brackets 301-302. Each bracket comprises a pair of arms 303-304 on which inwardly protrude a pair of short pins such as pins 306-307. Each pair of pins 306-307 is received by a corresponding pair of coaxial holes 316-317 in socket 320. The axis of holes 316-317 is perpendicular to the axis of a second pair of coaxial holes, of which 323 can be seen in FIG. 8.

Figure 9:
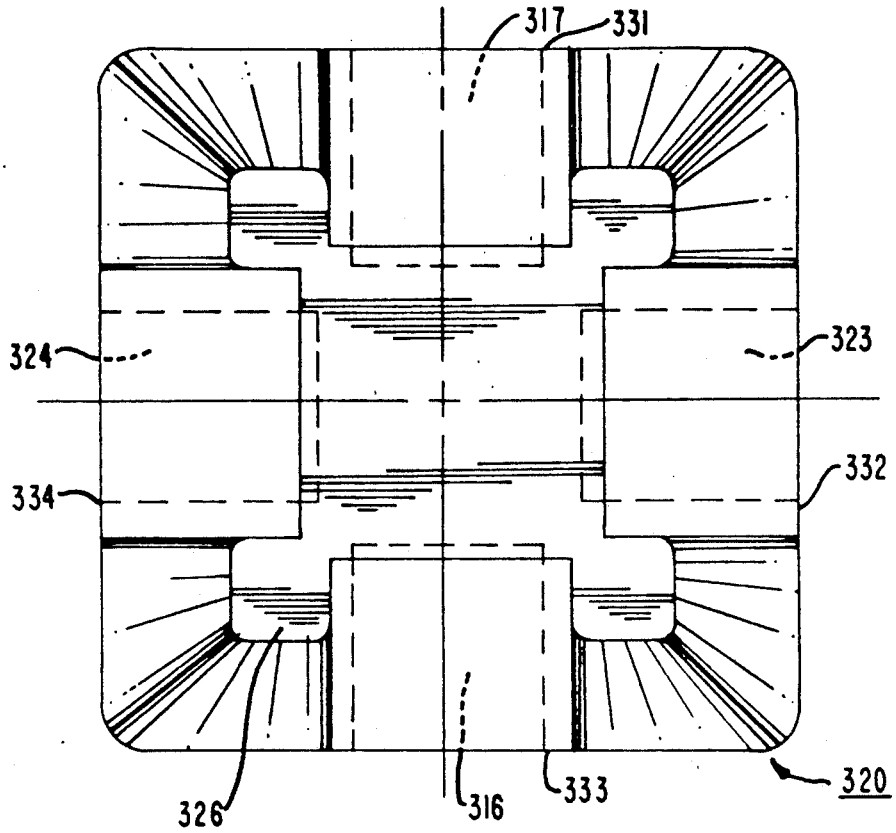
FIG. 9 is an elevation of a universal joint socket.

When viewed end-on as in FIG. 9, socket 320 is seen to comprise four grooves from end surface 326 to sides 331-334. These grooves help guide short pins 306-307 (FIG. 8) towards holes 316-317 (FIG. 8), 323-324 (FIG. 9), and help wedge apart arms 303-304 and the arms of bracket 302 (FIG. 8) during assembly of the universal joint.

Figure 10:
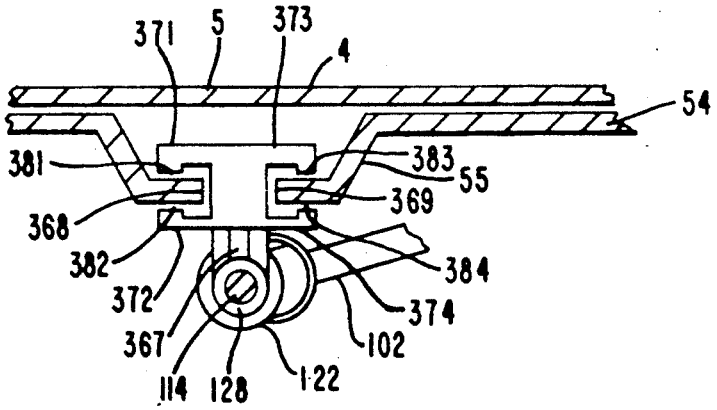
FIG. 10 is an elevation a universal joint guide, the plastic sheets of the playing rink being shown in section.

FIG. 10 shows the guide bearing 128 of joint 122 in elevation as it sits on protrusion 55 of undersheet 54 shown in section. Bearing 128 rotatably holds shaft 114. Bearing 128 is mounted atop post 367 suspended near edges 368-369 of sheet 54 by arms 371-374, which extend to opposite sides of post 367. Arms 371-374 comprise sliders 381-384 which run on upper and lower surfaces of undersheet 54 on protrusion 55 near edges 368-369.

Figure 5:
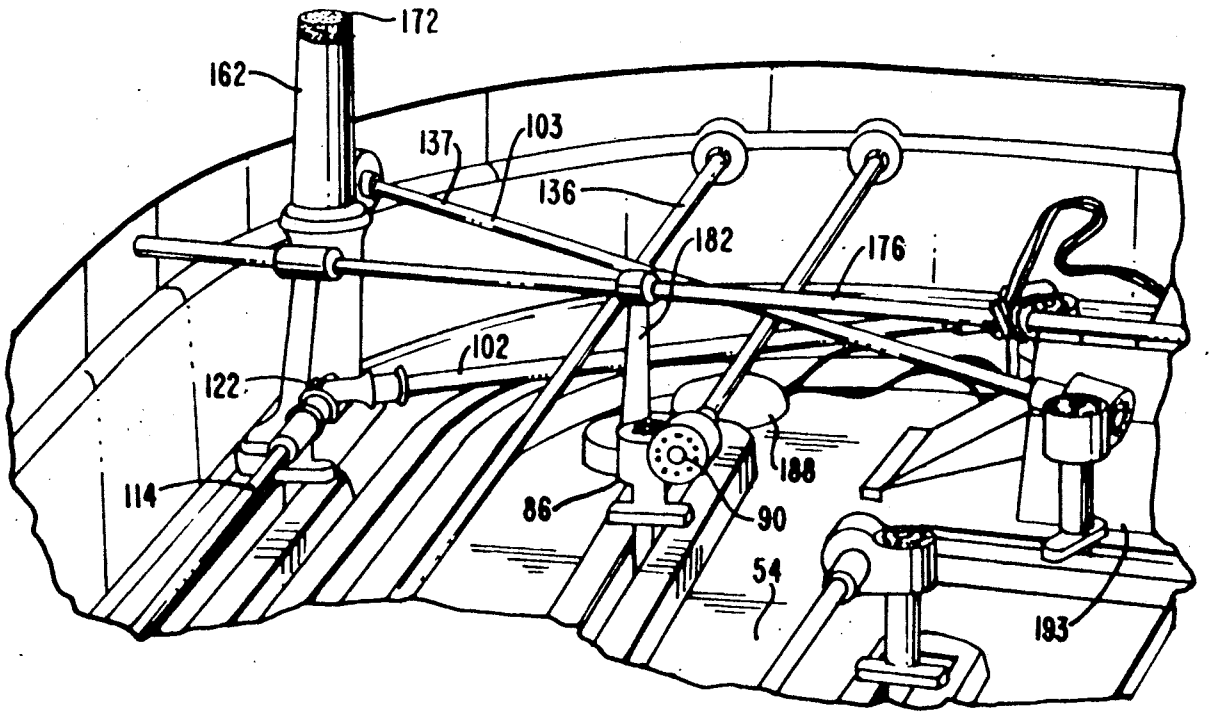
FIG. 5 is a closer perspective view from below of actuator shafts.

As can be seen in FIG. 5, in order to allow the sweeping movement of the toy players, the actuator shafts have been placed on a plurality of levels 135-137 so that the articulated shafts such as 102-122-114 can sweep above the other player shafts, underneath which slide the laterally moving goalie actuator shafts 103.

As in FIG. 1, each shaft terminates at its operator end in a fluted knob such as 138 which facilitates rotation by the operator.

Figure 6:
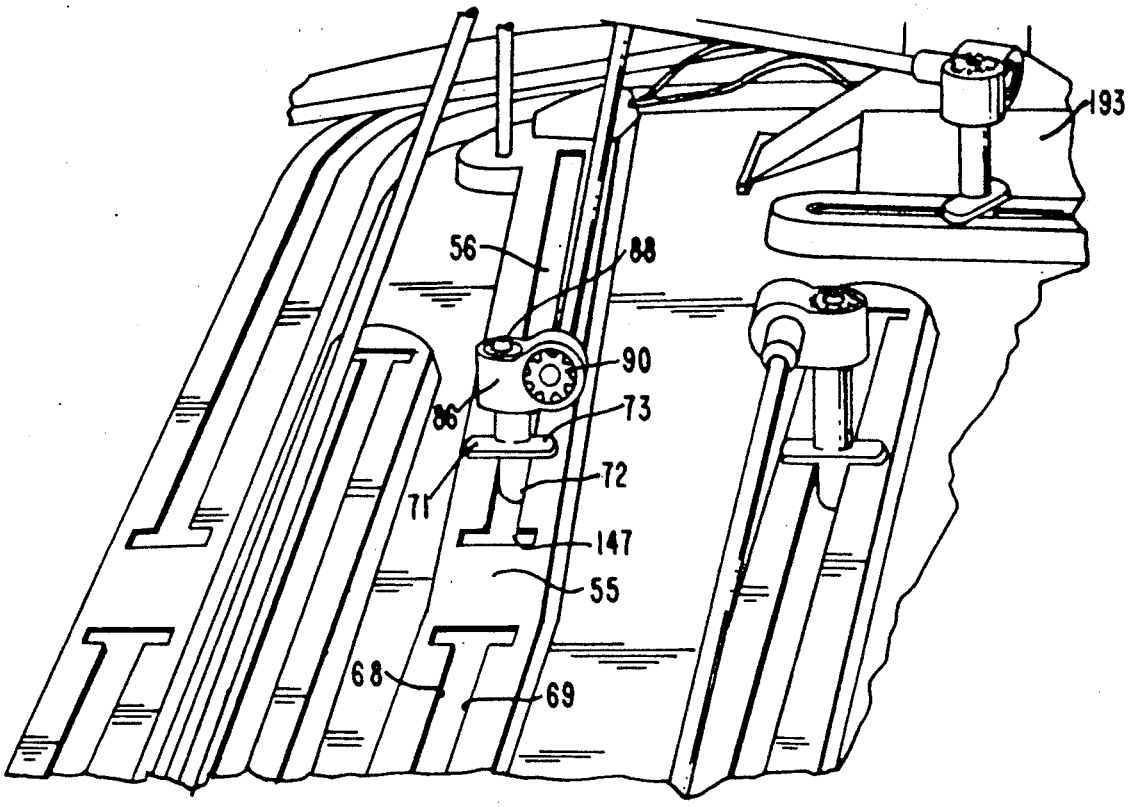
FIG. 6 is a perspective view from below detailing actuators and guides.

As in FIG. 6, each lower slot 56 terminates at its end distal to the operator in a widening such as 147 sufficient to fit arms 71-74 therethrough. This facilitates assembly during manufacture of the gaming apparatus.

As in FIGS. 2 and 5, triangularly braced legs 161-164 depend from undersheet 54 and terminate at their bottoms in rubber feet 171-174. Cross-braces 176, 177 extend through legs 161-164 across the gaming apparatus and brace undersurface 54 towards their centers via bracing struts 181-184. The understructure 186, 187 of the goals is also shown herein. This understructure comprises battery mounts 189, 190 and puck ejectors 191, 192. Each goal comprises a magnetic switch 193 (FIG. 6) which, in response to the proximity of a puck in the goal, actuates score lights 196, 197 shown in FIG. 1.

Also shown in FIG. 1 are scoreboards 201, 202 each of which comprise numbered board 204 and sliding tab 206.

To play the game, the person operating each team grasps the actuator shaft knobs 138 and slides the actuators in and out while rotating the actuator shafts. The sliding of the actuator shaft results in translational motion of the associated toy player and the rotation of the actuator shaft results in rotational motion of the player. The steel sticks attract the magnetic puck and can be used to gently manipulate the puck into a position for hitting the puck by either rotational or translational motion of the player towards the opponent's goal. By skillful manipulation of the players, the puck can be passed, shot at a goal and blocked in an exciting miniature simulation of ice hockey.

I claim:

1. A table hockey game having:

a playing surface, goals disposed midway between transverse edges of the surface and disposed at a distance from a respective longitudinal end, a plurality of toy hockey players representative of two teams, said surface extending behind each goal to that goal's longitudinal end of the playing surface, rods and universal joints comprising means for moving two toy players of a team, to and from positions longitudinally directly behind each team's opponent's goal between said goal and said goal's respective playing surface's longitudinal end, said joints comprising means for articulating the rods in two planes relative to each other.

2. A table hockey game having a playing surface, goals and a plurality of toy hockey players, said surface extending behind each goal to a playing surface end, said game comprising:

means for moving two toy players, each player capable of both longitudinal motion in a straight line and transverse motion in a straight line, to and from positions behind each opponent's goal between said goal and said goal's respective playing surface end;

guide means for restricting movement of a toy hockey player;

said guide means comprising:

a first pair of horizontally spaced parallel edges at the playing surface, a second pair of horizontally spaced parallel edges, in vertically spaced parallel relation to the first pair of edges;

two pairs of arm means for riding on the second pair of horizontally spaced parallel edges, one of said two pairs of arm means for riding above the second pair of edges, the other of said two pairs of arm means for riding below.

3. A table hockey game having a playing surface, goals and a plurality of toy hockey players, said game comprising:

guide means for restricting movement of a toy hockey player;

actuator means for moving the player along the guide means and for rotating the player:

said actuator means comprising:

a pair of rotatable shafts connected to each other by a universal joint; each universal joint comprising means for both rotational and translational movement of the rotatable shafts in a common horizontal plane along the guide means and further for movement of said rotatable shafts relative to one another in a direction substantially perpendicular to said common horizontal plane.

4. A table hockey game having a playing surface, goals and a plurality of toy hockey players, said game comprising:

guide means for restricting movement of a toy hockey player;

said guide means comprising:

a first pair of horizontally spaced parallel edges of the playing surface, a second pair of horizontally spaced parallel edges, in vertically spaced parallel relation to the first pair of edges, and two pair of arms, each arm comprising a slider means for running along a surface adjacent the second pair of horizontally spaced edges.

5. A table hockey game comprising:

a playing surface;

goals;

a plurality of of toy hockey players;

means for moving two toy players to and from positions behind an opponent's goal; said means comprising:

guide means for restricting movement of a toy hockey player, said guide means comprising:

a first pair of horizontally spaced parallel edges at the playing surface;

a second pair of horizontally spaced parallel edges, in vertically spaced parallel relation to the first pair of edges;

actuator means for moving the player along the guide means, and for rotating the player, said actuator means comprising:

a vertical shaft;

a shaft tube housing the vertical shaft;

two pairs of arms, each pair on a side of the shaft tube;

each arm comprising a slider means for running along a surface adjacent the second pair of edges;

a pair of rotatable actuator shafts connected to each other by a universal joint;

transmission means for connecting the vertical shaft to one of the actuator shafts and for rotationally driving the vertical shaft by rotation of the actuator shafts.

6. Apparatus according to claim 5 having a plurality of actuator shafts; said actuator shafts disposed at a plurality of distances below the playing surface.

* * * * *

UNITED STATES PATENT AND TRADEMARK OFFICE

CERTIFICATE OF CORRECTION

PATENT NO. : 5,046,734

DATED : 9/10/91

INVENTOR(S) : Klas I. Laine

It is certified that error appears in the above-identified patent and that said Letters Patent are hereby corrected as shown below:

Column 4, line 17 "each" should be --said--; and

Signed and Sealed this

Second Day of February, 1993

*Attest:*

STEPHEN G. KUNIN

*Attesting Officer*

*Acting Commissioner of Patents and Trademarks*